US007108636B1

(12) United States Patent
Garcia

(10) Patent No.: US 7,108,636 B1
(45) Date of Patent: Sep. 19, 2006

(54) PORTABLE EXERCISE APPARATUS

(76) Inventor: Gustavo N. Garcia, 1437 Kasten Dr., Dolton, IL (US) 60419

( * ) Notice: Subject to any disclaimer, the term of this patent is extended or adjusted under 35 U.S.C. 154(b) by 570 days.

(21) Appl. No.: 10/656,444

(22) Filed: Sep. 8, 2003

(51) Int. Cl.
*A63B 21/068* (2006.01)
*A63B 1/00* (2006.01)

(52) U.S. Cl. ..... 482/40; 482/96; 482/139; 482/141; 482/904

(58) Field of Classification Search ..... 482/23, 482/24, 33, 35–40, 44, 49, 94, 95, 96, 139, 482/106–109, 141, 148, 904, 907, 908; D21/691, D21/679
See application file for complete search history.

(56) References Cited

U.S. PATENT DOCUMENTS

| | | | | | |
|---|---|---|---|---|---|
| 3,207,511 | A | * | 9/1965 | Hoffman | 482/42 |
| 3,342,484 | A | * | 9/1967 | Christensen | 482/24 |
| 3,642,278 | A | * | 2/1972 | Hinckley | 482/38 |
| 3,707,285 | A | * | 12/1972 | Martin | 482/38 |
| 3,947,023 | A | | 3/1976 | Martin | |
| 4,358,106 | A | | 11/1982 | Shadford | |
| 4,620,701 | A | * | 11/1986 | Mojden | 482/41 |
| 4,657,242 | A | * | 4/1987 | Guridi | 482/40 |
| 4,844,448 | A | | 7/1989 | Niznik | |
| 4,858,917 | A | * | 8/1989 | Montgomery | 482/106 |
| 4,872,667 | A | * | 10/1989 | Favot | 482/106 |
| 5,226,868 | A | | 7/1993 | Montgomery | |
| 5,389,055 | A | * | 2/1995 | Gangloff | 482/38 |
| 5,417,628 | A | | 5/1995 | Vanderbleek | |
| 5,518,485 | A | * | 5/1996 | Zislis | 482/131 |
| 5,536,229 | A | * | 7/1996 | Albergo | 482/148 |
| 6,179,748 | B1 | | 1/2001 | Barr | |
| 6,217,483 | B1 | * | 4/2001 | Kallassy | 482/38 |
| 6,398,673 | B1 | * | 6/2002 | Maruca | 482/40 |

* cited by examiner

*Primary Examiner*—Jerome Donnelly
*Assistant Examiner*—Victor K. Hwang

(57) ABSTRACT

A portable exercise apparatus includes a hollow central bar member and telescopic end portions operably insertable therein. Such telescopic end portions allow the central bar member to be securely engaged between a pair of vertical members. A plurality of spring members are disposed within the hollow portion of the central bar member and provide resistive force for assisting to maintain the telescopic end portions at stable positions during operating conditions. The central bar member further includes a plurality of apertures spaced along an outer surface thereof and for receiving a plurality of fastening members therethrough so that a plurality of handle members can be selectively positioned along the length of the central bar member. The handle members preferably have first and second portions integral with each other wherein the first portion extends substantially perpendicular from the central bar member and the second portion extends obliquely from the first portion.

3 Claims, 4 Drawing Sheets

PORTABLE EXERCISE APPARATUS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to an apparatus for performing upper body exercises and more particularly, to a portable exercise apparatus with telescoping ends and adjustable grip handles that a user can grasp in order to perform a variety of exercises.

2. Prior Art

Presently, there is an increased awareness of the importance of good health. The medical industry has made significant technological advances and people are more aware of the positive effect that proper diet and exercise can have on life expectancy. Toward that end, an increasing number of people closely monitor their diet and participate in some form of physical exercise in order to maintain their health and increase their chances of living longer.

The active and busy lifestyles of many individuals often necessitates an exercise program that can be completed in a short period of time without having to travel a long distance to a gym or other exercise facility. The ability to exercise outdoors in one's neighborhood is often negatively impacted by adverse weather conditions, limited number of daylight hours, traffic, and the prevalence of criminal activity. Therefore, indoor exercise in one's home, office or hotel room is often the best and most convenient choice for a place to exercise. Perhaps the most common indoor exercises are pull-ups and chin-ups. Such types of exercise require minimum equipment in terms of size and cost. Pull-ups and chin-ups may be done on any convenient horizontal bar or support which may be grasped by a user. Such activities may be performed using any number of devices of modest cost and size that may be mounted with respect to a door opening. The great majority of devices of this type require coupling through screws or the like to the periphery of a door opening. Such coupling, however, normally involves defacing of the door that leaves an unsightly appearance when the device is removed.

One other disadvantage of a straight pull-up or chin-up bar is that it limits the number of exercises, and therefore, the number and type of muscles that can be exercised. Current exercise training programs focus much more narrowly on individual muscles in order to ensure a more comprehensive exercise program. An adjustable exercise bar with adjustable appendages mounted to it would enable a user to exercise more upper body muscles than an ordinary straight pull-up or chin-up bar does.

Accordingly, a need remains for a portable and adjustable exercise apparatus that will fit different sizes of openings, not deface the surface it is secured to, and provide adjustable appendages for exercising varied upper body muscles.

BRIEF SUMMARY OF THE INVENTION

In view of the foregoing background, it is therefore an object of the present invention to provide a portable apparatus for exercising indoors. These and other objects, features, and advantages of the invention are provided by a portable exercise apparatus that includes a central bar member with a hollow interior and opposed end portions. The central bar has a plurality of apertures randomly disposed between the opposed end portions and about the perimeter thereof.

The portable exercise apparatus further includes a pair of telescopic end members that can be inserted into and removed from the hollow interior of the central bar member in order to selectively adjust the overall length. The telescopic end portions have stop members attached thereto for assisting a user to engage the portable exercise apparatus between a pair of vertical members such as a frame of a door, for example. Spring members are preferably disposed adjacent to the opposed end portions of the central bar member and within the hollow interior thereof. Such spring members provide resistive force to the telescopic members when same are pushed inwardly towards the center of the central bar member. Advantageously, the central bar member is securely engageable within a doorframe, for example.

The portable exercise apparatus further includes a plurality of handle members and a plurality of corresponding fastening members for selectively attaching the handle members to the central bar member by passing the fastening members through the plurality of apertures, respectively. The handle members have first and second portions integral with each other wherein the first portion extends substantially perpendicularly from the central bar member and the second portion preferably extends obliquely from the first portion.

The portable exercise apparatus may further include a plurality of grip members attached to the plurality of handle members, respectively. The grip members are preferably attached to the second portion of the respective handle members.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
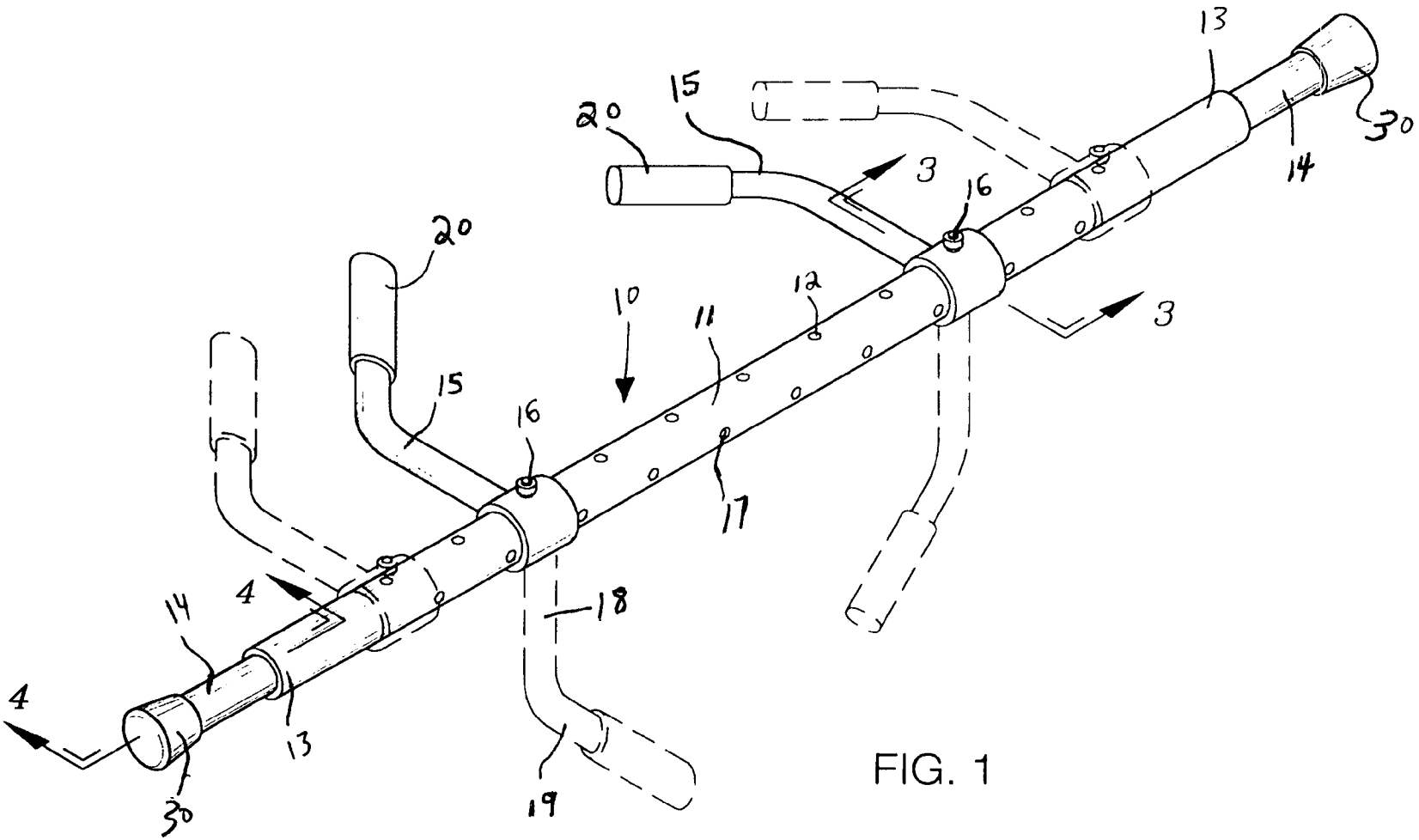
FIG. 1 is a perspective view showing a portable exercise apparatus, in accordance with the present invention.

The present invention will now be described more fully hereinafter with reference to the accompanying drawings, in which a preferred embodiment of the invention is shown. This invention may, however, be embodied in many different forms and should not be construed as limited to the embodiments set forth herein. Rather, this embodiment is provided so that this application will be thorough and complete, and will fully convey the true scope of the invention to those skilled in the art.

The apparatus of this invention is referred to generally in FIGS. 1–5 by the reference numeral 10 and is intended to provide a portable exercise apparatus. It should be understood that the apparatus 10 may be used to perform many different types of exercises and, therefore, should not be limited to pull-ups and chin-ups.

The portable exercise apparatus 10 includes a central bar member 11 having a hollow interior and a plurality of apertures 17 randomly disposed about the perimeter thereof between opposed end portions 13. The portable exercise apparatus 10 further includes a pair of telescopic end members 14, with stop members 30, removably insertable into the hollow interior of the central bar member 11 so that a user can selectively adjust the length to fit various size door openings or other spaces defined between two vertical members. Such stop members 30 may be formed from conventional rubber material for assisting to prevent the central bar member 11 from disengaging during operating conditions.

Figure 2:
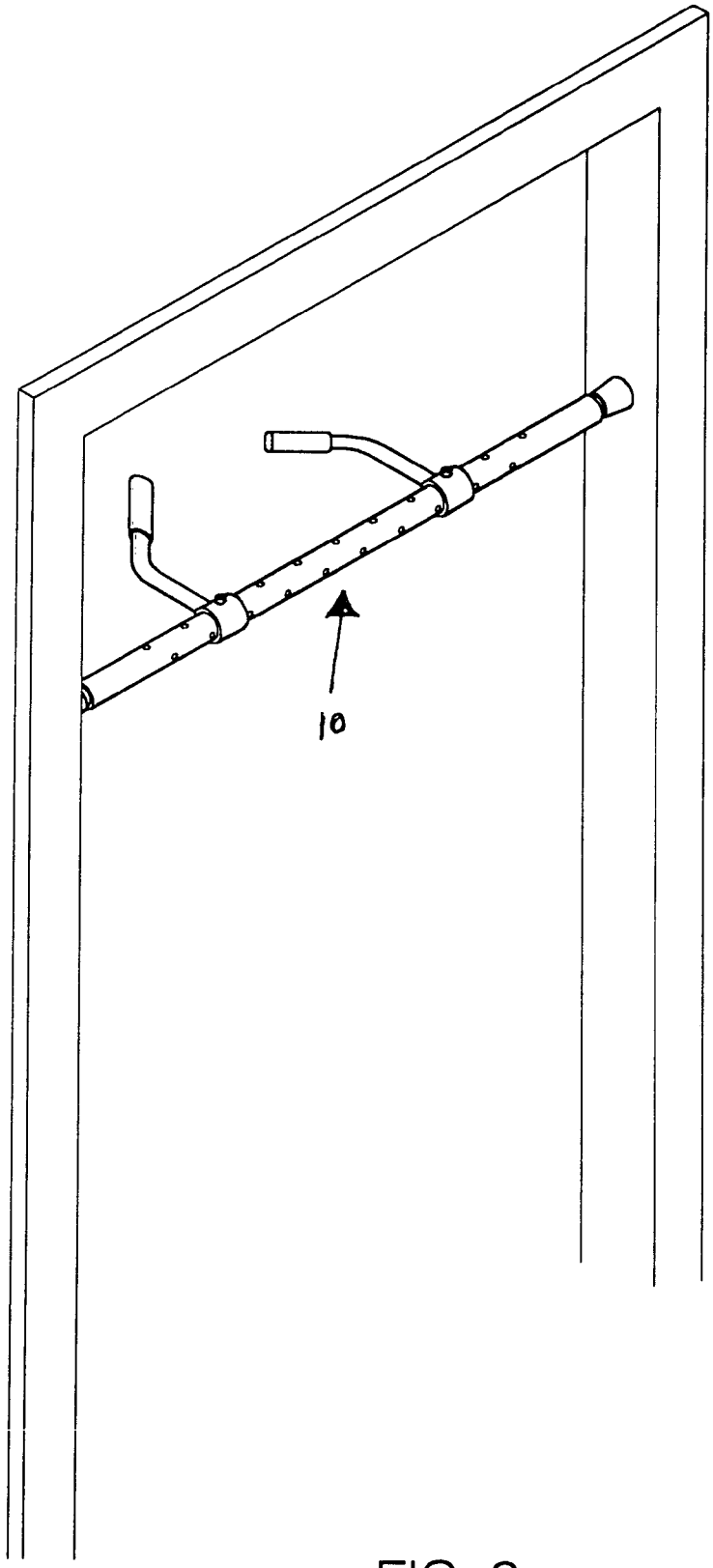
FIG. 2 is a perspective view showing the present invention in a preferred environment.
Figure 3:
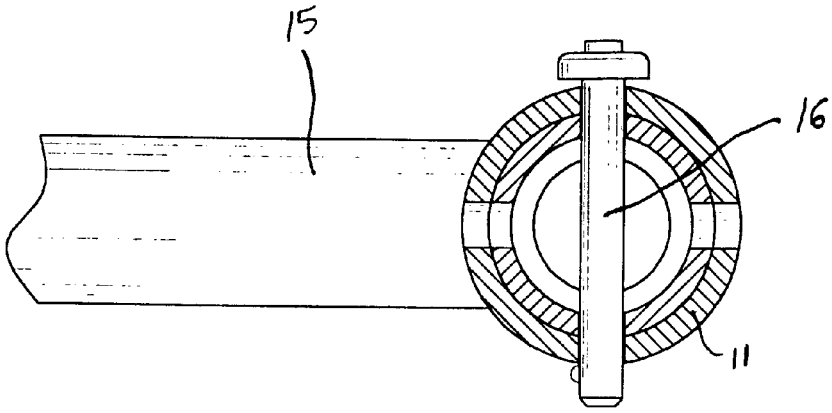
FIG. 3 is a cross sectional view of a fastening member inserted through a handle member and central bar member.
Figure 4:
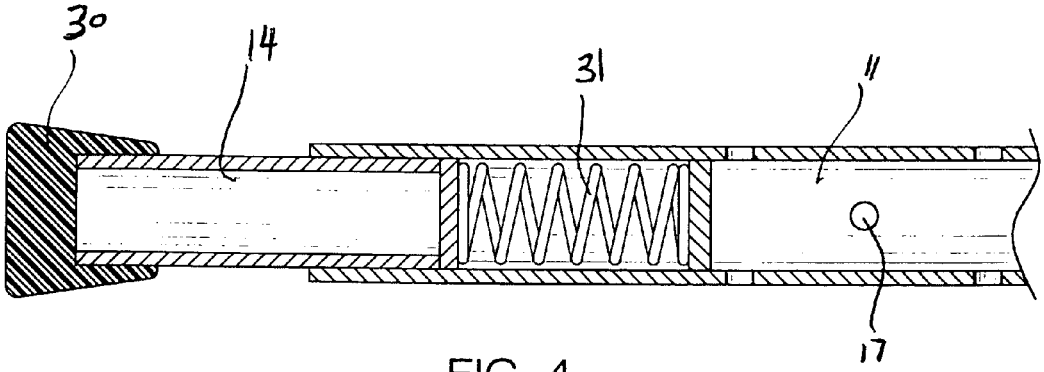
FIG. 4 is a cross sectional view of a resistive spring member operably engageable with a corresponding telescoping end portion.
Figure 5:
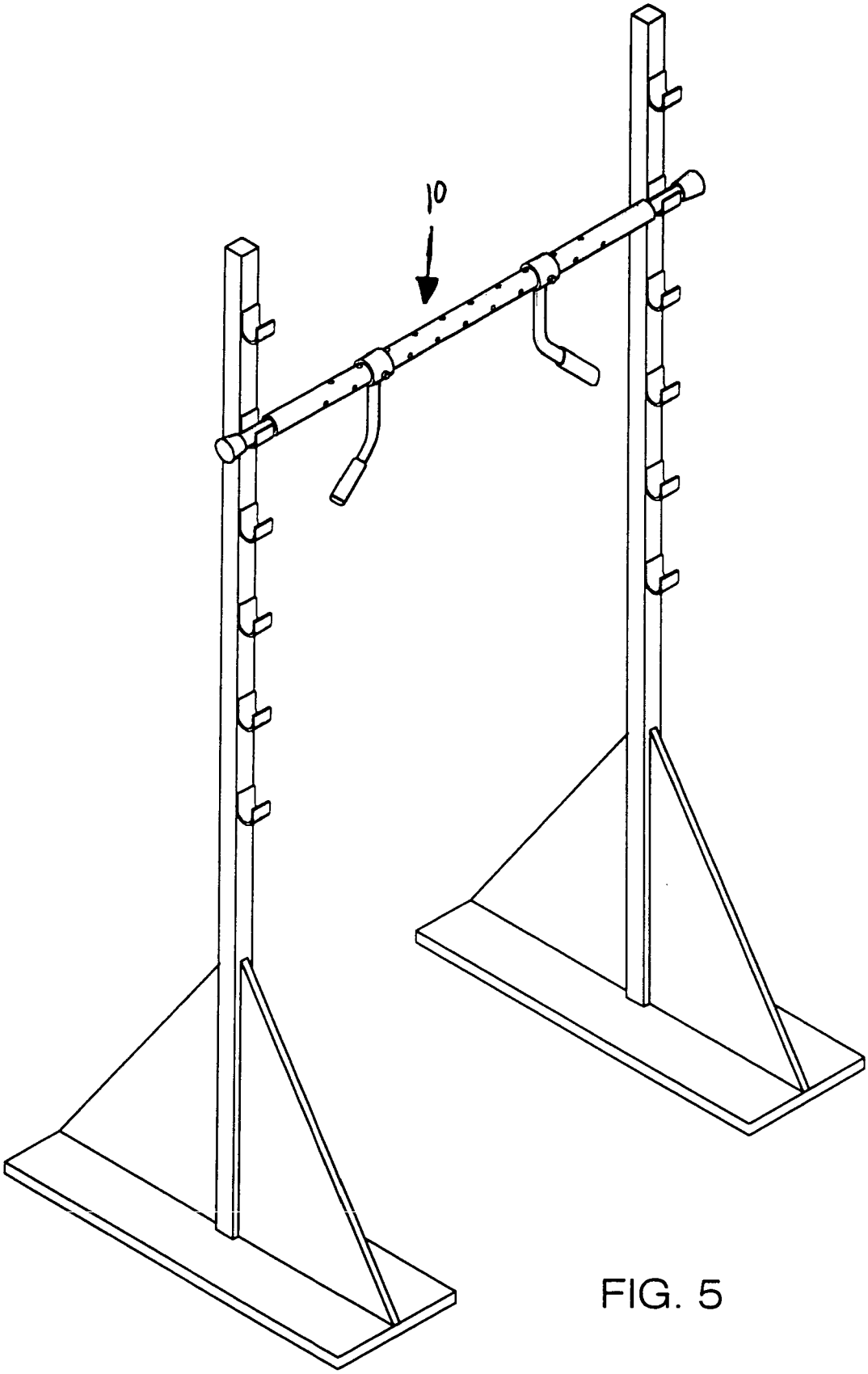
FIG. 5 is a perspective view showing the present invention in an alternate environment.

Now referring to FIGS. 2 and 4, the central bar member 11 is secured to a pair of vertical members, such as a door opening, by the resistive force provided by the spring members 31. In particular, such spring members are disposed adjacent to the opposed end portions 13 of the central bar member 11 and within the hollow interior thereof and help maintain the telescoping end members 14 at stable positions when same are pushed inwardly towards the center of the central bar member 11.

The portable exercise apparatus 10 further includes a plurality of handle members 15 and a plurality of fastening members 16 for selectively attaching the handle members 15 to the central bar member 11, as perhaps best shown by FIG. 1. Such fastening members 16 may include conventional quick release pins, as well known to a person of ordinary skill in the art. The user selects which apertures 17 to use for attaching the handle members 15 to the central bar member 11 by passing the fastening members 16 through the handle members 15 and the selected apertures 17. The spacing of the apertures 17 allows a user to position the handle members 15 in a variety of locations along the length of the central bar member 11 and at varying angles. This enables the user to isolate select muscles during operating conditions.

The handle members 15 have first 18 and second 19 portions integral with each other wherein the first portion 18 extends substantially perpendicularly from the central bar member 11 and the second portion 19 extends obliquely from the first portion 18. Of course, such handle members 15 may have alternate shapes, without departing from the true scope of the present invention. The second portion 19 of each handle member 15 is provided with a grip member 20 for assisting the user to maintain a secure grip while exercising.

While the invention has been described with respect to a certain specific embodiment, it will be appreciated that many modifications and changes may be made by those skilled in the art-without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A portable upper body exercise apparatus comprising:

a central bar member having a hollow interior and opposed end portions, said central bar member further having a plurality of apertures disposed between said opposed end portions and about a perimeter of said central bar member;

a plurality of telescopic end members being removably insertable into the hollow interior of said central bar member so a length of said apparatus can be selectively adjusted;

a plurality of rigid handle members and a plurality of fastening members for selectively attaching same to said central bar member by passing through at least a selected one of said plurality of apertures, said plurality of handle members having first and second portions integral with each other wherein said first portion extends substantially perpendicularly from said central bar member and said second portion extends obliquely from said first portion; and a plurality of grip members attached to said second portion of said plurality of handle members respectively.

2. The apparatus of claim 1, further comprising a plurality of stop members attached to said plurality of telescopic end portions and for assisting a user to engage said apparatus between a pair of vertical members.

3. The apparatus of claim 1, further comprising a plurality of spring members disposed adjacent said opposed end portions of said central bar member and within the hollow interior thereof, said plurality of spring members providing resistive force to said plurality of telescopic members when same are pushed inwardly towards a center of said central bar member.

* * * * *